US006574935B2

(12) United States Patent
Wang Chen

(10) Patent No.: US 6,574,935 B2
(45) Date of Patent: Jun. 10, 2003

(54) OPPOSITE INSERTED STRUCTURE FOR INJECTING FRAME OF DOOR LEAF WITH GLASS

(75) Inventor: Kuei Yung Wang Chen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 09/911,480

(22) Filed: Jul. 25, 2001

(65) Prior Publication Data

US 2003/0019178 A1 Jan. 30, 2003

(51) Int. Cl.[7] ..... E06B 3/70
(52) U.S. Cl. ..... 52/455; 52/204.62
(58) Field of Search ..... 52/455, 204.53, 52/456, 204.54, 204.62, 204.71, 204.72, 204.593, 204.67; 49/501

(56) References Cited

U.S. PATENT DOCUMENTS

| | | | | |
|---|---|---|---|---|
| 4,550,540 A | | 11/1985 | Thorn | 52/456 X |
| 5,133,168 A | * | 7/1992 | Neilly et al. | 52/204.5 |
| 5,644,870 A | | 7/1997 | Chen | 49/501 |
| 5,644,881 A | * | 7/1997 | Neilly | 49/505 |

* cited by examiner

*Primary Examiner*—Ramon O. Ramirez
(74) *Attorney, Agent, or Firm*—Stevens, Davis, Miller & Mosher, LLP

(57) ABSTRACT

A door assembly structure with glass according to this invention is formed from one door leaf, which is rectangular shape with an opening for glass installed therein; two identical glass injected-frames, which is provided with inside frame and outside frame which is at a position bevel to inside frame, and which outside frame has a flat surface inside on which has a recess, and at inside frame an inner rib with flat surface is formed along its inner edge and a middle rib with flat surface is also formed at a distance parallel to inner rib so that a recess formed in between inner rib and middle rib and a space formed beside middle rib, wherein at a certain distance to middle rib several tenons and several slot mortises in interval with symmetrical position is formed so that by tenon and slot mortise joint one of two identical glass injected-frames may be jointed to the other which is turned in half circle; and at least one piece of glass, which size is smaller than opening of said door leaf and which appearance is similar to that of said opening of said door leaf.

Without using any general screws to assemble a door assembly structure with glass of this invention but by use of tenon and slot mortise joint. This invention is completely assembled as a whole door assembly structure with glass much more easily than before does and capably reduce cost without wasting working time.

9 Claims, 4 Drawing Sheets

OPPOSITE INSERTED STRUCTURE FOR INJECTING FRAME OF DOOR LEAF WITH GLASS

BACKGROUND OF THE INVENTION

1. Field of the Invention

The present invention relates to an assembled door structure, and more particularly, to a door assembly having a pair of injected-frames with symmetric tenon and slot mortise capably to be relatively assembled together by use of tenon and mortise joint as a wholly door with glass.

2. Description of the Related Art

As is known to all, in the prior art of manufacturing traditional door with glass, general screws are most commonly used as joint parts to assembly this kind of door leaf. In recent years, however, this kind of traditional doors with glass mentioned above, particularly assembled by use of screws, is gradually replaced by other type of halving structure of glass assembling door. Therefore, there is an advantage for halving structure of glass assembling door because it may be jointed together by halved joint to mostly reduce general screws to be used as joint parts. But problems are still introduced in door assembly manufacturing process. For example, 1. The prior halving structure of glass assembling door comprises two different shapes of glass injected-frames, due to the necessity of making two different glass injected-frame molds, so that the manufacturing cost for prior halving structure door is so higher.
2. The prior halving structure of glass assembling door still needs to be locked by screws manually and to be decorated by a screw lid. Therefore, the assembling process is much more complicated.

SUMMARY OF THE INVENTION

One aspect of this invention is without using any general screws to assemble a door assembly structure with glass but by use of tenon and slot mortise joint so that the present invention is completely assembled as a door assembly structure with glass much more easily than before does and capably reduce cost without wasting working time.

Another aspect of this invention is used two same product made from the same extrusion or injection molds as two glass injected-frames for assembling parts so that this present invention capably reduces cost very much. Which material may be selected from those material such as wood, aluminum extrusion, polystyrene, polyvinyl chloride, polyvinyl chloride with wood powder, polypropylene, and polypropylene with glass fiber etc. which outer surface is provided with smooth surface or to simulate wood graining.

In accordance with further aspect of this invention, a door assembly structure with glass comprises: one door leaf, which is rectangular shape with an opening for glass installed therein; two identical glass injected-frames, which is provided with inside frame and outside frame which is at a position bevel to inside frame, and which outside frame has a flat surface inside on which has a recess, and at inside frame an inner rib with flat surface is formed along its inner edge and a middle rib with flat surface is also formed at a distance parallel to inner rib so that a recess formed in between inner rib and middle rib and a space formed beside middle rib, wherein at a certain distance to middle rib several tenons and several slot mortises in interval with symmetrical position is formed so that one of identical glass injected-frames by tenon and slot mortise joint may be jointed to the other turned in half circle; and at least one piece of glass, which size is smaller than opening of said door leaf and which appearance is similar to that of said opening of said door leaf.

A door assembly structure with glass of this invention is provided with the tenon of glass injected-frame having a projection at front end, and on surface of mortise of glass injected-frame having two slots at a distance. Therefore, there are two embodiments of this invention to be carried out for door leaf with thinner thickness or thicker thickness. By tenon and slot mortise joint, the space between one glass injected-frame and the other injected-frame may be changeable in accordance to the projection of tenon of one glass injected-frame inserted into different slot 18 of relative slot mortise of the other glass injected-frame. When space between one glass injected-frame and the other glass injected-frame is arranged come to narrower space, it is suitable for use in door leaf with thinner thickness, and, on the other hand, come to broader space, it is suitable for use in door leaf with thicker thickness.

BRIEF DESCRIPTION OF THE DRAWINGS

The invention will be better understood by reference to the following drawings when reading the description of the invention contained herein.

DETAILED DESCRIPTION OF THE PREFERRED EMBODIMENTS

The features and advantages of this invention are described in this specification in conjunction with the drawings illustrating a preferred embodiment of the invention.

Figure 1:
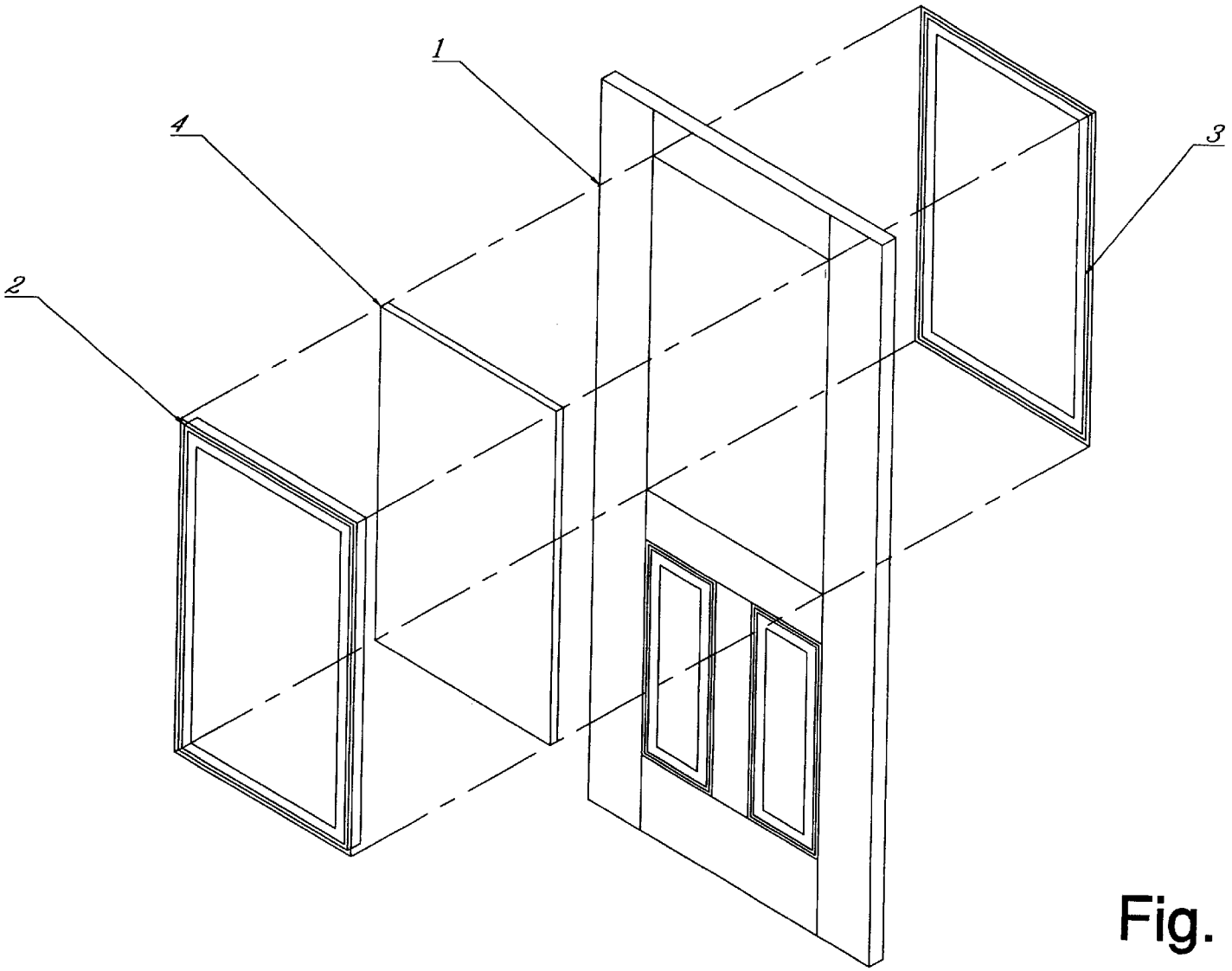
FIG. 1 is an exploded view of the door assembly structure of the present invention.

As shown in FIG. 1 a door assembly structure with glass of this invention comprises a door leaf 1 which is rectangular shape with an opening for glass 4 installed therein, two totally identical glass injected-frames 2, 3 with symmetric tenon 15 and slot mortise 14 (refer to FIG. 3), and at least one piece of glass 4 which size is smaller that of opening of door leaf 1.

The opening of said door leaf 1 for glass 4 installed therein may be formed by CNC machining as various appearance such as square, rectangular, round, ellipse and semi-circular shape. So that said glass 4 with smaller size may also be formed as corresponding shape to that of opening of said door leaf 1 in which said glass 4 may be installed inside.

Figure 3:
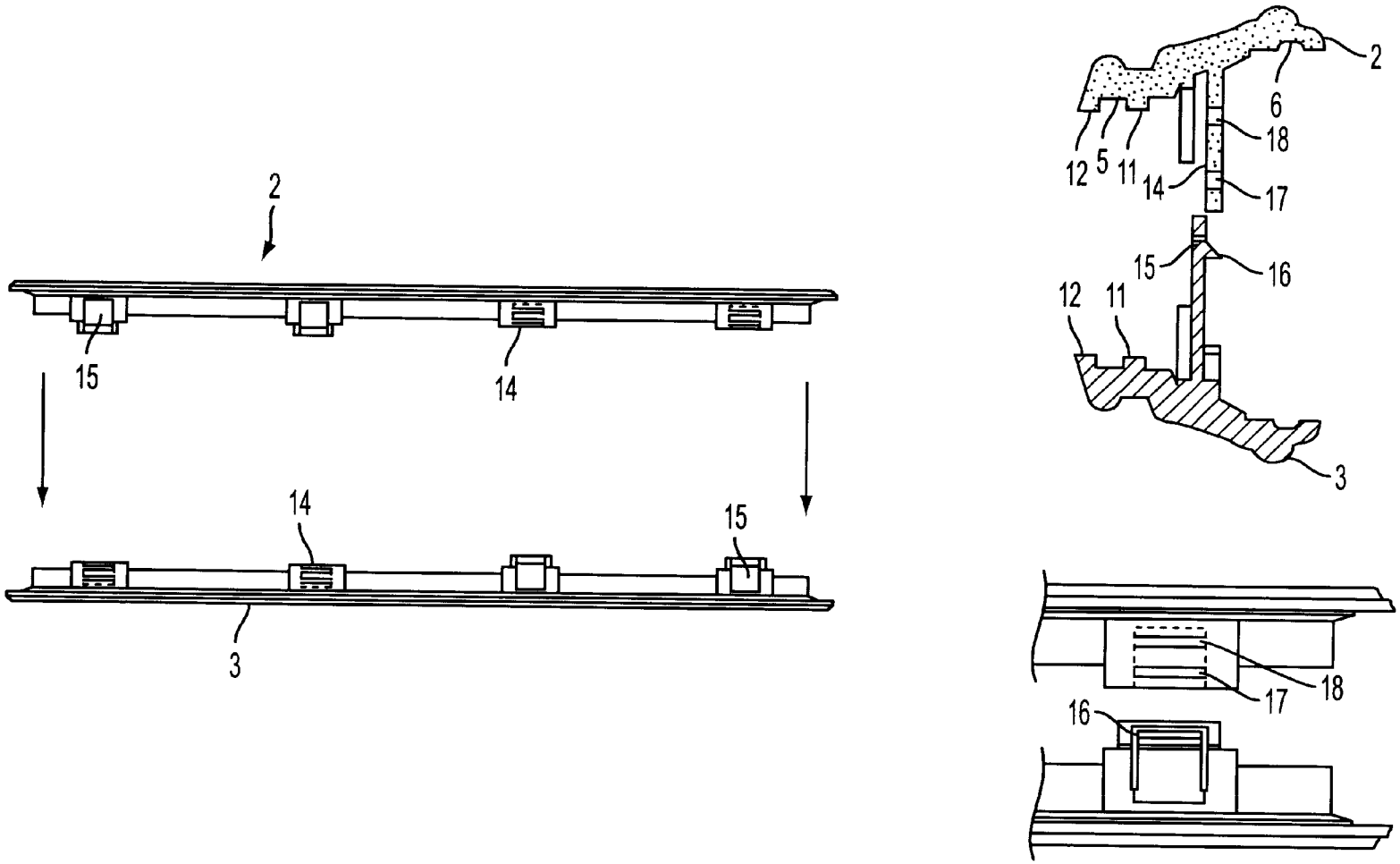
FIG. 3 is an explanatory drawing to indicate how this pair of glass ejected-frames of the present invention be jointed together by tenon and mortise joint.

As shown in FIG. 3, said totally identical glass injected-frames 2, 3 are the same product made from the same extrusion or injection molds. Which material may be selected from those material such as wood, aluminum extrusion, polystyrene, polyvinyl chloride, polyvinyl chloride with wood powder, polypropylene, and polypropylene with glass fiber etc. which outer surface is provided with smooth surface or to simulate wood graining.

At the inside frame of said glass injected-frame 2 or 3, there are an inner rib 12 with flat surface is formed along the inner edge and a middle rib 11 with flat surface also is formed at a distance parallel to said inner rib 12 so that a recess 5 to be formed is surrounded in between said inner rib 12 and said middle rib 11, and a space 13 beside middle rib 11 is then formed also. Moreover, the flat surface of said inner rib 12 is with a higher height about 0.5 mm to that of flat surface of said middle rib 11. The outside frame of said glass injected-frame 2 or 3, which inside surface is provided with flat surface, is at a position bevel to that inside frame as shown in FIG. 2 or FIG. 3 so that another recess 6 may be formed along the flat surface of outer frame of said glass injected-frame 2 or 3.

Inside frame of said glass injected-frame 2 or 3, along both side, or another embodiment along periphery, several symmetric tenons 15 and slot mortise 14 as shown in FIG. 3 is formed in between the inner frame and outer frame of said glass injected-frame 2 or 3. As a Result, one of glass injected-frame 2 or 3 is once selected as tenon parts and another is then taken as mortise parts by just directly rotating it in half circle, so that said glass injected-frame 2 may be matched together to said glass injected-frame 3.

At proper position of front end of said tenon 15 is provided with a projection 16, and there are two slots 17, or 18 at a distance formed on the surface of said slot mortise 14. Therefore, said glass injected-frame 2 may be jointed together to said glass injected-frame 3 by tenon and slot mortise joint when said projection 16 of said tenon 15 is inserted into one of said slot 17 or 18 of said slot mortise 14.

Figure 2:
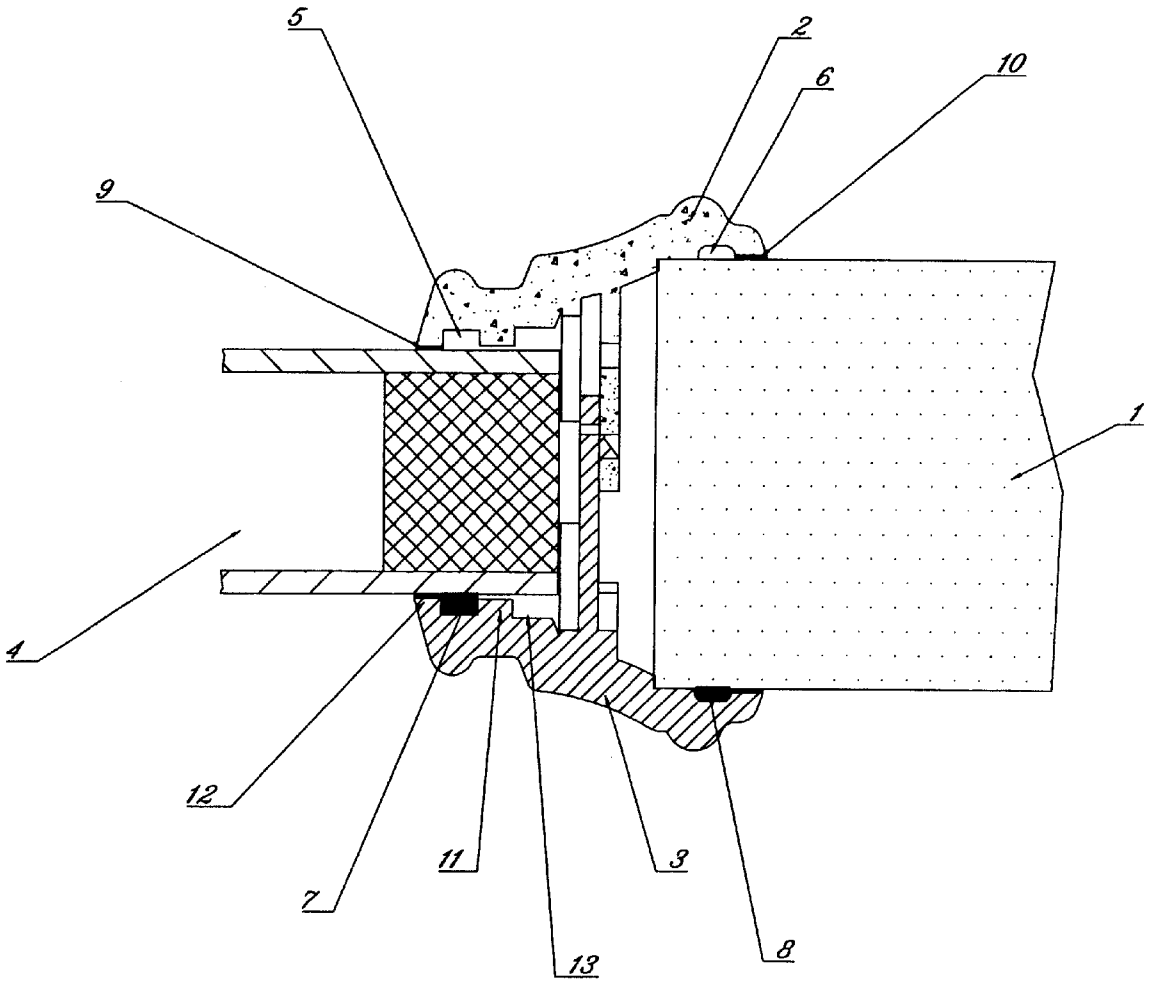
FIG. 2 is a vertical section drawing of FIG. 1 indicating the door assembly structure of the present invention.

When proceeding door assembly as shown in FIG. 2, which assembling steps is in accordance with the follows:

(a) Alternatively selecting said glass injected-frame 2 or 3 first, for example, said glass injected-frame 2 selected, then putting on silicon 7 within said recess 5 of the inside frame of said glass injected-frame 2 to have said glass 4 be secured with good airtight effect, and said recess 6 do the same way as that of said recess 5;

(b) Said glass injected-frame 2 is installed against the opening of said door leaf 1 to have it be securely adhered together to said door leaf 1 by use of said silicon 8. At this time, the flat surface with recess 6 of inside outer frame of said glass injected-frame 2 capably is attached to skin surface of said door leaf 1. If for enhancing waterproof effect, a soft packing 10 may be provided in between the flat surface with recess 6 of inside outer frame of said glass injected-frame 2 and said door leaf 1, and it is better for putting said packing 10 at flat surface beside to recess 6 and directed to outside as shown in FIG. 2;

(c) Subsequently put at least one piece of said glass 4, with similar appearance and smaller size to that of opening of said door leaf 1, against to said glass injected-frame 2 by its front face and which bottom end is also stand against to the rib of said glass injected-frame 2 designed to support glass weight and be positioned the said glass 4 as shown in FIG. 2 and FIG. 3. Then said glass 4 may be securely adhered together to said glass injected-frame 2 by use of said silicon 7 within said recess 5. At this time, because the flat surface of said inner rib 12 is with a higher height about 0.5 mm to that of flat surface of said middle rib 11, some of said silicon 7 within said recess 5, when compression, is flowed out due to compression therein and into the said space 13 by through the gap between said glass 4 and said middle rib 11. So that the flat surface of said rib 12 capably is attached to skin surface of said glass 4, and said glass 4 may be then adhered together to glass injected-frame 2 by use of silicon 7 at position of said recess 5 and said space 13. If for enhancing waterproof effect, a soft packing 12 may be provided in between the flat surface of said inner rib 12 and said glass 4.

(d) After then, another said glass injected-frame 3 in half circle turned is installed at the other side against the opening of said door leaf 1. By tenon and slot mortise joint, each said tenon 15 and each said slot mortise 14 of said glass injected-frame 2 may be relatively be jointed to each said mortise 14 and each tenon 15 of said glass injected-frame 3 by way of said projection 16 of said tenon 15 to be inserted into said slot 17 or said slot 18. Moreover, said glass injected-frame 3, by the same way as said glass injected-frame 2 used for being securely adhered together to said door leaf 1 and said glass 4 and enhancing airtight and waterproof effect mentioned before, may make use of silicon 8 at said recess 6 and silicon 7 at said recess 5 and said space 13 to securely adhere together to said door leaf 1 and said glass 4, and may make use of a soft packing 9 and soft packing 10 to enhance airtight and waterproof effect.

Therefore, by use of tenon and slot mortise joint a door assembly structure with glass this invention is then completed much more easily without using any general screws for joint, so that this invention capably reduce cost without wasting working time.

EXAMPLE

Figure 4:
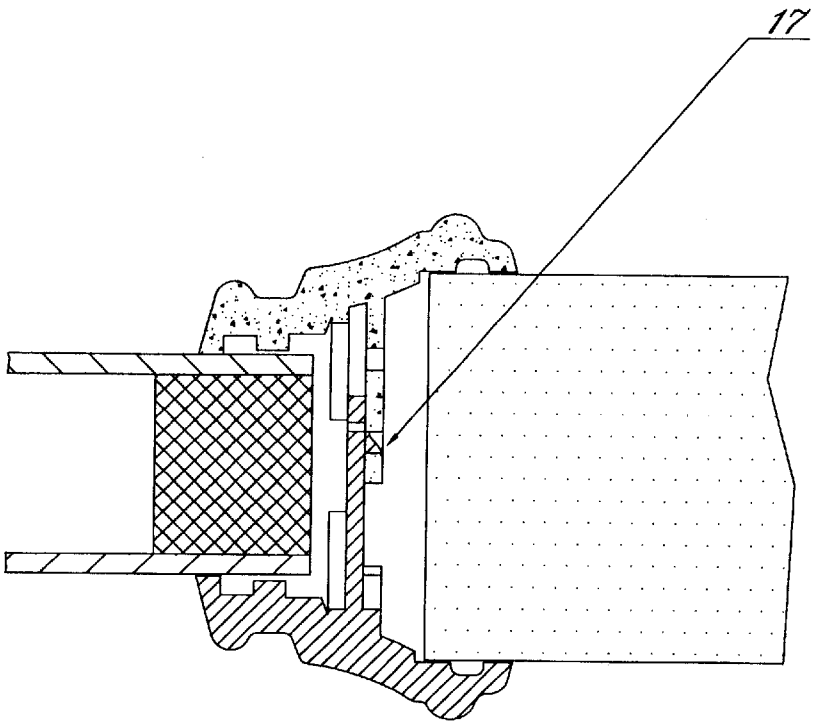
FIG. 4 is one embodiment of the present invention used in door leaf with thinner thickness.

There are two embodiments of a door assembly structure with glass of this invention capably to be carried out. If said door leaf 1 is with thinner thickness as shown in FIG. 4, by tenon and slot mortise joint to have said projection 16 of said tenon 15 directly inserted into said slot 18 of relative said slot mortise 14, the space between said glass injected-frame 2 and said injected-frame 3 therefore come to narrower space may be suitable for use in said door leaf 1 is with thinner thickness.

Figure 5:
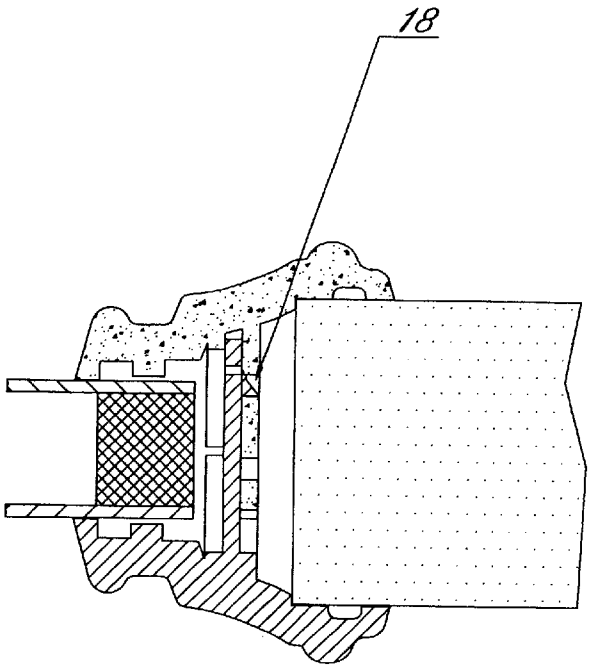
FIG. 5 is another embodiment of the present invention used in door leaf with thicker thickness.

And If said door leaf 1 is with thicker thickness as shown in FIG. 5, by tenon and slot mortise joint to have said projection 16 of said tenon 15 directly inserted into said slot 17 of relative said slot mortise 14, the space between said glass injected-frame 2 and said injected-frame 3 therefore come to broader space may be suitable for use in said door leaf 1 is with thicker thickness.

What I claimed is:

1. A door assembly structure with glass comprising:

one door leaf, which is rectangular shape with an opening for glass installed therein;

two identical glass injected-frames, which is provided with inside frame and outside frame at a position bevel to said inside frame, which said outside frame has a flat surface inside on which has a recess, and at said inside frame an inner rib with flat surface is formed along its inner edge and a middle rib with flat surface is also formed at a distance parallel to said inner rib so that a recess formed in between said inner rib and said middle rib and a space formed beside middle rib, wherein at a certain distance to said middle rib several tenons and several slot mortises in interval with symmetrical position is formed so that one of said identical glass injected-frames by tenon and slot mortise joint may be jointed to the other turned in half circle; and at least one piece of glass, which size is smaller than said opening of said door leaf and which appearance is similar to that of said opening of said door leaf.

2. A door assembly structure with glass according to claim 1, wherein flat surface of said inner rib of said glass injected-frame is with a higher height about 0.5 mm to that of flat surface of said middle rib.

3. A door assembly structure with glass according to claim 1, wherein the appearance of said opening of said door leaf is square, rectangular, round, ellipse or semi-circular shape.

4. A door assembly structure with glass according to claim 1, wherein said glass injected-frame is made of wood, aluminum extrusion, polystyrene, polyvinyl chloride, polyvinyl chloride with wood powder, polypropylene, or polypropylene with glass fiber material.

5. A door assembly structure with glass according to claim 4, wherein outer surface of said glass injected-frame is provided with smooth surface or to simulate wood graining.

6. A door assembly structure with glass according to claim 1, wherein said tenon of said glass injected-frame is provided with a projection at front end, and on surface of said mortise of said glass injected-frame is provided with two slots at a distance.

7. A door assembly structure with glass according to claim 1, wherein a soft packing is provided in between the flat surface inside outer frame of said glass injected-frame and said door leaf.

8. A door assembly structure with glass according to claim 1, wherein a soft packing is provided in between flat surface of said inner rib of said glass injected-frame and said glass.

9. A method of assembling a door structure, comprising:

placing silicon in a first recess and a second recess disposed in a first frame;

overlapping a door leaf with the first recess and overlapping an opening within the door leaf with the second recess;

adhering the first frame to the door leaf with the silicon placed in the first recess;

placing a window pane in the door leaf opening to overlap the second recess;

adhering the window pane to the first frame with the silicon placed in the second recess;

compressing the window pane against the first frame to produce a flow of the silicon from the second recess through a gap formed between a boundary of the second recess and the window pane into a space between said window pane and said first-frame;

placing a second frame opposite to the first frame so that a first portion of the second frame overlaps the door leaf on a side of the door leaf opposite to that attached to the first frame and so that a second portion of the second frame overlaps the window pane on a side opposite to that attached to the first frame;

securing the first frame to the second frame to prevent movement of the complementary frames relative to one another by interconnecting a tenon of either the first frame or the second frame, through the opening, with a mortise of the other one of the first frame or the second frame to secure the first frame and the second frame from shifting their positions relative to one another along a first axis of three-dimensional space, wherein a projection disposed on the tenon is inserted into a slot disposed in a boundary of the mortise to secure the first frame and the second frame from shifting their positions relative to one another along second and third axes of the three-dimensional space.

* * * * *